US006468724B2

(12) United States Patent
Tappe et al.

(10) Patent No.: US 6,468,724 B2
(45) Date of Patent: Oct. 22, 2002

(54) COLOR PHOTOGRAPHIC DEVELOPER CONCENTRATE

(75) Inventors: Gustav Tappe, Leverkusen (DE); Matthias Porger, Köln (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/876,276

(22) Filed: Jun. 7, 2001

(65) Prior Publication Data

US 2001/0036605 A1 Nov. 1, 2001

Related U.S. Application Data

(63) Continuation-in-part of application No. 09/593,429, filed on Jun. 14, 2000, now abandoned.

(30) Foreign Application Priority Data

Jun. 17, 1999 (DE) ..... 199 27 601

(51) Int. Cl.[7] ..... G03C 7/413
(52) U.S. Cl. ..... 430/466
(58) Field of Search ..... 430/466

(56) References Cited

U.S. PATENT DOCUMENTS

| | | | | |
|---|---|---|---|---|
| 4,232,113 | A | 11/1980 | Marchaseno | 430/450 |
| 5,200,302 | A | 4/1993 | Iwano | 430/376 |
| 5,891,608 | A | 4/1999 | Hashimoto et al. | 430/458 |
| 5,948,604 | A | 9/1999 | Craver et al. | 430/458 |

FOREIGN PATENT DOCUMENTS

| | | |
|---|---|---|
| DE | 29 10 251 | 9/1979 |
| DE | 38 01 536 | 7/1989 |

*Primary Examiner*—Hoa Van Le
(74) *Attorney, Agent, or Firm*—Connolly Bove Lodge & Hutz LLP

(57) ABSTRACT

A two-part color photographic developer concentrate in which part 1 contains at least one antioxidant selected from the group consisting of diethylhydroxylamine and diethylhydroxylamine disulfo acid, at least one auxiliary solvent, at least one optical brightener and at least one color developer substance and part 2 contains at least one buffer substance, alkali and at least one water softener, may be produced by part 1 additionally containing 0.001 to 1 mol of hydroxylamine or a monoalkylated hydroxylamine or the salts thereof per liter of concentrate concentrate and at least 20% by weight of the total of part 1 being water.

7 Claims, No Drawings

COLOR PHOTOGRAPHIC DEVELOPER CONCENTRATE

RELATED APPLICATIONS

This application is a continuation-in-part of Ser. No. 09/593,429 filed Jun. 14, 2000, now abandoned.

The developer solution for developing color photographic materials, in particular for developing color photographic paper, is prepared from or, in the case of continuous operation, replenished with concentrates which contain the necessary constituents.

It is conventional to provide three different concentrates, as certain constituents of the developer bath are not mutually compatible on extended storage. Thus, for example, one concentrate contains the antioxidant, an auxiliary solvent and an optical brightener, a second concentrate contains the color developer substance, for example CD 3 (N-ethyl-N-(2-methylsulfonylaminoethyl)-3-methyl-p-phenylenediamine) and a third concentrate contains the buffer substance, alkali and a water softener.

The first concentrate is alkaline (approx. pH 10), the second is strongly acidic and thus stable with regard to color developer concentration and the third is strongly alkaline. A small quantity of sulfite is generally added to the concentrate of the color developer substance for stabilisation purposes. The quantity of sulfite must not be too large as it otherwise has a negative impact on sensitometry (inhibition of development and thus reduction of color densities).

There has been no lack of attempts to develop stable, one-part color developer concentrates as handling errors during preparation or replenishing of a developer solution may consequently be avoided.

Two one-part concentrates are currently commercially available, a) Monoline® RA-4 CD-R from Tetenal, a two-phase concentrate with a solid, undissolved phase deposited at the bottom and b) TriPhase® RA-4 CD-R from Trebla, a three-phase concentrate with undissolved constituents in the middle phase (c.f. also U.S. Pat. No. 5,891,609).

In both cases, the presence of undissolved constituents is disadvantageous for the purposes of handling the concentrate. Especially when preparing the regenerating solution, problems may occur because the undissolved constituents dissolve only poorly.

A two-part concentrate of a color developer is known from U.S. Pat. No. 4,232,113. The part containing the developer substance which is a p-phenylenediamine compound contains only organic solvents and has to be substantially free of water. This is disadvantageous on an economical as well as on an ecological view.

The object of the invention was to provide a two-part concentrate for a color developer, neither part of which contains any undissolved constituents, from which parts a regenerating solution may rapidly be produced, which parts comprise a single phase and which avoid larger amounts of organic solvents.

This object is achieved by part 1 of the two-part concentrate containing diethylhydroxylamine or diethylhydroxylamine disulfo acid as the antioxidant containing the auxiliary solvent, the optical brightener, the color developer substance, 0.001 to 1 mol of hydroxylamine or a monoalkylated hydroxylamine or the salts thereof per liter of concentrate and at least 20% by weight, preferably at least 30% by weight of water based on the total of part 1.

Preferably, 0.005 to 0.3 mol of hydroxylamine or monoalkylated hydroxylamine or the salts thereof are used, particularly preferably hydroxylammonium sulfate.

Part 1 preferably has a pH of 1.5 to 6.

Part 2 of the two-part concentrate corresponds to the previous part 3, comprising the buffer substance, alkali and water softener.

Monoalkylated hydroxylamine is preferably of the formula

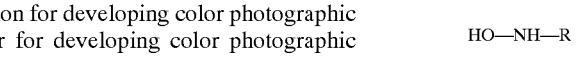

HO—NH—R in which

R means $C_1$–$C_{10}$-alkyl, hydroxy-$C_1$–$C_{10}$-alkyl, $C_1$–$C_{10}$-alkoxy-$C_1$–$C_{10}$-alkyl carboxy-$C_2$–$C_{10}$-alkyl, dicarboxy-$C_1$–$C_{10}$-alkyl, carboxyhydroxy-$C_1$–$C_{10}$-alkyl, hydroxy-$C_1$–$C_5$-alkyl-(oxy-$C_1$–$C_5$-alkyl)$_n$, $C_1$–$C_5$-alkoxy-$C_1$–$C_5$-alkyl(oxy-$C_1$–$C_5$-alkyl)$_n$ or aryl and n means a number from 1 to 4.

EXAMPLES

The following Examples describe concentrated (parts 1, 2 and 3, or parts 1 and 2), from which developer solutions were prepared in the stated manner. A portion of each of the concentrates was stored for 1 week at 60° C. before use and then compared with the freshly produced concentrates. Table 1 shows the differences in yellow fog of a material based on silver chloride emulsions which was processed with these developer solutions.

Example 1 (Comparison)

| | |
|---|---|
| Part 1 | |
| Polyethylene glycol, average MW 400 | 300 ml |
| Diethylhydroxylamine, 85 wt. % aqueous solution (DEHX solution) | 120 ml |
| Optical brightener | 20 g |
| Water to make up to | 1000 ml |
| pH 10 | |
| Part 2 | |
| CD 3 | 280 g |
| Sodium disulfite | 10 g |
| Water to make up to | 1000 ml |
| pH 1 | |
| Part 3 | |
| Potassium hydroxide | 65 g |
| Potassium carbonate | 600 g |
| EDTA | 3 g |
| Water to make up to | 1000 ml |
| pH 14 | |

The color of the stored concentrates is unchanged in comparison with the fresh preparations.

A color developer working solution was then prepared from these concentrates. 35 ml of part 1, 17.5 ml of part 2 and 35 ml of part 3 were used per liter. The pH is adjusted to 10.2 with potassium hydrogen carbonate. 2 g of potassium chloride were added per liter. The preparation is light yellow and clear and thus matches the preparation made from the fresh, unstored concentrates.

Photographic materials were processed in these two preparations. The two processed materials (in fresh, unstored concentration or in stored concentrate) exhibit no sensitometric differences (Table 1).

Example 2 (Comparison)

In this Example, parts 1 and 2 from Example 1 were combined to form a new part 1 of the following composition.

Since not all the substances from part 1 of Example 1 dissolve at pH 1, the pH value was raised.

Part 2 is identical to part 3 of Example 1.

| Part 1 | |
|---|---|
| Polyethylene glycol of an average MW of 400 | 375 ml |
| DEHX solution | 150 ml |
| Optical brightener | 25 g |
| CD 3 | 250 g |
| Sodium disulfite | 6.2 g |
| Water to make up to pH 5 | 1000 ml |

The color of the stored concentrate, part 1, is distinctly darkened and deep brown in comparison with the fresh preparations.

A color developer working solution was then prepared from these concentrates. 28 ml of part 1 and 35 ml of part 2 were used per liter. The pH is adjusted to 10.2 with potassium hydrogen carbonate. 2 g of potassium chloride are added per liter. The preparation is dark and turbid, while the preparation made from the fresh, unstored concentrates is light in color and clear.

Example 3 (Comparison)

As Example 2, but the part 1 concentrate is adjusted to pH 3.

The color of the stored part 1 concentrate is distinctly darkened and deep brown in comparison with the fresh preparations.

The preparation is dark and turbid, while the preparation made from the fresh, unstored concentrates is light in color and clear.

Example 4 (Comparison)

As Example 2, but the sulfite is omitted from the part 1 concentrate.

The color of the stored concentrate, part 1, is distinctly darkened and deep brown.

Example 5 (According to the invention)

As Example 3, but the sodium disulfite is replaced by 5 g of hydroxylammonium sulfate.

The color of the stored concentrate, part 1, is unchanged in comparison with the fresh preparation.

Example 6 (According to the invention)

As Example 2, but with 150 g of caprolactam instead of the polyethylene glycol and additionally with 5 g of hydroxylammonium sulfate.

The color of the stored concentrate, part 1, is unchanged in comparison with the fresh preparation.

Example 7 (According to the invention)

| Part 1 | |
|---|---|
| Triethanolamine | 250 ml |
| HADS* | 120 g |

-continued

| Part 1 | |
|---|---|
| Optical brightener | 25 g |
| CD 3 | 250 g |
| Hydroxylammonium sulfate | 5 g |
| Water to make up to pH 3 | 1000 ml |

*Diethylhydroxylamine disulfo acid

Part 2 is identical to part 3 of Example 1.

The color of the stored concentrate, part 1, is identical to that of the fresh preparation.

TABLE 1

(Yellow fog of processed material)

| | Yellow $D_{min} \times 1000$ | |
|---|---|---|
| | fresh | stored |
| Example 1 (Comparison) | 114 | 116 |
| Example 2 (Comparison) | 114 | 137 |
| Example 3 (Comparison) | 115 | 155 |
| Example 4 (Comparison) | 113 | 132 |
| Example 5 (Invention) | 114 | 116 |
| Example 6 (Invention) | 113 | 115 |
| Example 7 (Invention) | 114 | 116 |

TABLE 2

(CD 3 loss due to storage of concentrate for 1 week at 60° C.)

| | CD 3 content [g/l] | |
|---|---|---|
| | fresh | stored |
| Example 1 (Comparison) | 5.0 | 4.8 |
| Example 2 (Comparison) | 5.0 | 4.1 |
| Example 3 (Comparison) | 5.0 | 3.8 |
| Example 4 (Comparison) | 5.0 | 4.3 |
| Example 5 (Invention) | 5.0 | 4.8 |
| Example 6 (Invention) | 5.0 | 4.7 |
| Example 7 (Invention) | 5.0 | 4.9 |

It is evident that only the two-part concentrates according to the invention achieve the performance of the three-part concentrate with regard to yellow fog and stability.

What is claimed is:

1. Two-part color photographic developer concentrate which comprises part 1 and part (2), said part (1) contains at least one antioxidant selected from the group consisting of diethylhydroxylamine and diethylhydroxylamine disulfo acid, at least one auxiliary solvent, at least one optical brightener, at least one color developer substance and 0.001 to 1 mol of hydroxylamine or a monoalkylated hydroxylamine or the salts thereof per liter of concentrate and at least 20% by weight of the total of part (1) is water and part 2 contains at least one buffer substance, alkali and at least one water softener.

2. The developer concentrate according to claim 1, wherein said part (1) contains 0.005 to 0.3 mol of hydroxylamine or a monoalkylated hydroxylamine or the salts thereof per liter of concentrate.

3. The developer concentrate according to claim 1, wherein said color developer substance is N-ethyl-N-(2-methylsulfonylaminoethyl)-3-methyl-p-phenylenediamine.

4. The developer concentrate according to claim 1, wherein said part (1) has a pH of 1.5 to 6.

5. The developer concentrate according to claim 2, wherein said part (1) has a pH of 1.5 to 6 and contains N-ethyl-N-(2-methylsulfonylaminoethyl)-3-methyl-p-phenylenediamine as the color developer substance.

6. The developer concentrate according to claim 2, wherein said part (1) contains a hydroxylammonium sulfate.

7. The eveloper concentrate according to claim 1, wherein the monoalkylated hydroxylamine is of a formula

HO—NH—R wherein

R is $C_1$–$C_{10}$-alkyl, hydroxy-$C_1$–$C_{10}$-alkyl, $C_1$–$C_{10}$-alkoxy-$C_1$–$C_{10}$-alkyl, carboxy-$C_2$–$C_{10}$-alkyl, dicarboxy-$C_1$–$C_{10}$-alkyl, carboxyhydroxy-$C_1$–$C_{10}$-alkyl, hydroxy-$C_1$–$C_5$-alkyl-(oxy-$C_1$–$C_5$-alkyl)$_n$, $C_1$–$C_5$-alkoxy-$C_1$–$C_5$-alkyl-(oxy-$C_1$–$C_5$-alkyl)$_n$ or aryl and n is a number from 1 to 4.

* * * * *

UNITED STATES PATENT AND TRADEMARK OFFICE

CERTIFICATE OF CORRECTION

PATENT NO. : 6,468,724 B2
DATED : October 22, 2002
INVENTOR(S) : Tappe et al.

It is certified that error appears in the above-identified patent and that said Letters Patent is hereby corrected as shown below:

Title page,
Item [56], OTHER PUBLICATIONS, please add the following -- Patent Abstract of Japan, vol. 1997, no. 01, 31 January 1997, & JP 08 248600 A (Konica Corp.), 27 September 1996. --.

Signed and Sealed this

Fourth Day of February, 2003

JAMES E. ROGAN
*Director of the United States Patent and Trademark Office*